US010543963B2

(12) United States Patent
Valles et al.

(10) Patent No.: US 10,543,963 B2
(45) Date of Patent: Jan. 28, 2020

(54) CLOSURE COMPRISING A PIERCEABLE PART AND CONTAINER PROVIDED WITH SUCH CLOSURE

(75) Inventors: Vanessa Valles, Hasselt (BE); Daniel Peirsman, Bornem (BE); Sarah Vanhove, Boutersem (BE)

(73) Assignee: ANHEUSER-BUSCH INBEV S.A., Brussels (BE)

( * ) Notice: Subject to any disclaimer, the term of this patent is extended or adjusted under 35 U.S.C. 154(b) by 571 days.

(21) Appl. No.: 12/812,874

(22) PCT Filed: Jan. 15, 2009

(86) PCT No.: PCT/EP2009/050441
§ 371 (c)(1),
(2), (4) Date: Oct. 19, 2010

(87) PCT Pub. No.: WO2009/090223
PCT Pub. Date: Jul. 23, 2009

(65) Prior Publication Data

US 2011/0024422 A1 Feb. 3, 2011

(30) Foreign Application Priority Data

Jan. 15, 2008 (EP) ..... 08100516

(51) Int. Cl.
*B65D 41/00* (2006.01)
*B65D 41/20* (2006.01)

(52) U.S. Cl.
CPC ..... *B65D 41/205* (2013.01)

(58) Field of Classification Search
CPC ..... B01L 3/02; B01L 3/14; B01L 3/50825; B01L 2200/026; B01L 2200/0684; B01L 2200/141; B01L 2300/044; B01L 2300/042; B01L 2300/046; B01L 2300/047; B01L 2300/048; B01L 2300/0609; B65D 51/00; B65D 41/205; G01N 35/1079
USPC ..... 215/347, 364, 250; 604/415; 264/267
See application file for complete search history.

(56) References Cited

U.S. PATENT DOCUMENTS

| | | | | |
|---|---|---|---|---|
| 1,694,851 A | | 12/1928 | Glass | |
| 2,085,392 A | | 6/1937 | Reichel | |
| 2,467,979 A | | 4/1949 | Krueger | |
| 3,047,177 A | | 7/1962 | Poitras et al. | |
| 3,144,154 A | | 8/1964 | Puse et al. | |
| 3,348,728 A | | 10/1967 | Love | |
| 3,438,529 A | | 4/1969 | Lohrer | |
| 3,450,254 A | | 6/1969 | Miles | |
| 3,484,011 A | | 12/1969 | Greenhalgh et al. | |
| 3,628,681 A | * | 12/1971 | Schwartz | 215/364 |
| 3,760,969 A | * | 9/1973 | Shimamoto et al. | 215/247 |

(Continued)

FOREIGN PATENT DOCUMENTS

| | | |
|---|---|---|
| DE | 814258 C | 9/1951 |
| DE | 969306 C | 5/1958 |

(Continued)

*Primary Examiner* — Ernesto A Grano
(74) *Attorney, Agent, or Firm* — Brooks Kushman P.C.

(57) ABSTRACT

A closure having a base with a piercable part, defined by a sidewall extending transversally with respect to the base and a bottom thereby creating an indent therein, the sidewall and/or bottom provided with several lines of weakened material strength, wherein the lines divide the sidewall and/or bottom in several wedge formed parts.

9 Claims, 3 Drawing Sheets

(56) References Cited

U.S. PATENT DOCUMENTS

| | | | | |
|---|---|---|---|---|
| 3,907,146 | A | 9/1975 | Fields | |
| 3,966,071 | A | 6/1976 | Northrup | |
| 4,159,790 | A | 7/1979 | Bailey | |
| 4,330,066 | A | 5/1982 | Berliner | |
| 4,365,721 | A | 12/1982 | Montgomery | |
| 4,635,814 | A | 1/1987 | Jones | |
| 4,700,860 | A | 10/1987 | Li | |
| 4,784,299 | A * | 11/1988 | Stenger | B67D 1/0829 222/397 |
| 4,892,230 | A | 1/1990 | Lynn, Jr. | |
| 4,984,713 | A | 1/1991 | Chambers et al. | |
| 5,031,787 | A | 7/1991 | Ochs | |
| 5,326,534 | A * | 7/1994 | Yamazaki et al. | 422/550 |
| 5,328,063 | A | 7/1994 | Beck et al. | |
| 5,370,252 | A * | 12/1994 | Parsons et al. | 215/247 |
| 5,435,460 | A | 7/1995 | Osgar | |
| 5,788,196 | A | 8/1998 | Forman | |
| 5,810,185 | A | 9/1998 | Groesbeck | |
| 5,853,096 | A | 12/1998 | Bartur et al. | |
| 5,904,965 | A * | 5/1999 | Noel et al. | 428/36.5 |
| 5,934,500 | A | 8/1999 | Cogger et al. | |
| 6,032,812 | A * | 3/2000 | Lamoureux | 215/303 |
| 6,158,604 | A | 12/2000 | Larguia, Sr. et al. | |
| 6,161,716 | A | 12/2000 | Oberhofer et al. | |
| 6,202,871 | B1 | 3/2001 | Kelly | |
| 6,220,311 | B1 | 4/2001 | Litto | |
| 6,230,922 | B1 | 5/2001 | Rasche et al. | |
| 6,679,395 | B1 | 1/2004 | Pfefferkorn et al. | |
| 6,716,396 | B1 | 4/2004 | Anderson et al. | |
| 6,848,599 | B2 | 2/2005 | Hammarth | |
| 7,111,763 | B2 | 9/2006 | Masuda | |
| 7,314,146 | B2 | 1/2008 | Mavin | |
| 7,367,479 | B2 | 5/2008 | Sitz | |
| 7,435,389 | B2 * | 10/2008 | Anderson et al. | 422/501 |
| 7,819,286 | B2 | 10/2010 | Antheil et al. | |
| 2001/0017306 | A1 | 8/2001 | Wan et al. | |
| 2003/0089735 | A1 | 5/2003 | Iwatsubo | |
| 2004/0060598 | A1 | 4/2004 | Danby et al. | |
| 2006/0144870 | A1 | 7/2006 | Anderson | |
| 2008/0093328 | A1 | 4/2008 | Gaillot et al. | |
| 2009/0008356 | A1 | 1/2009 | Gadzic et al. | |
| 2009/0057347 | A1 | 3/2009 | Leys | |
| 2010/0187230 | A1 | 7/2010 | Beer et al. | |
| 2011/0174760 | A1 | 7/2011 | Luzzato | |

FOREIGN PATENT DOCUMENTS

| | | | |
|---|---|---|---|
| DE | 1300463 | B | 7/1969 |
| EP | 1138609 | A1 | 10/2001 |
| EP | 1245499 | A1 | 10/2002 |
| EP | 1614636 | A1 | 1/2006 |
| GB | 1074165 | | 6/1967 |
| GB | 1545293 | | 5/1979 |
| GB | 2426508 | A | 11/2006 |
| WO | 9743188 | A1 | 11/1997 |
| WO | 9807575 | A1 | 2/1998 |
| WO | 0132525 | A1 | 5/2001 |

* cited by examiner

CLOSURE COMPRISING A PIERCEABLE PART AND CONTAINER PROVIDED WITH SUCH CLOSURE

FIELD OF THE INVENTION

The present invention is directed to a closure of the type having a base comprising a piercable part, the piercable part being defined by a sidewall extending transversally with respect to the base and a bottom thereby creating a indent in the base, said sidewall and/or bottom comprising several lines of weakened material strength. Particularly the invention concerns a closure of the above mentioned type for sealing container, especially containers for storing carbonated beverages such as beer.

BACKGROUND OF THE INVENTION

It is generally known to seal containers with closures defining a piercable part, where through a dispensing means can be inserted into the container thereby allowing dispensing the fluid stored therein. With the increasing demand for home appliance systems for dispensing beverages stored in small sized containers, new requirements arise in terms of handling safety, hygiene, and durability.

Closures have been cited in the art that comprise a piercable part formed by a flexible diaphragm. Such closures however can only be pierced when using a needle or dispensing means having a sharp tip, resulting in a safety hazard that is undesired for home appliances. Other types of closures such as cited in GB 1,074,165 have base comprising a piercable part defined by a conical sidewall and a bottom, the sidewall extending transversally with respect to the base, wherein at the perimeter of the bottom is provided a circular line of reduced material thickness. The line of reduced material thickness allows piercing with a rounded dispensing means, thereby overcoming safety issues for consumers. A drawback of the configuration of the piercable part according to GB 1,074,165 is that during piercing, the bottom of the piercable part is loosened from the closure and falls into the container whereon the closure is provided. From a hygienically point of view, the contamination of a fluid contained in the container by part of the closure is undesirable. Another drawback associated to parts of the closure falling into the container is a safety hazard, as the loosened parts can be drawn out of the container together with a beverage contained therein, such that they can be swallowed by consumers. Yet another drawback is that the loosened parts can obstruct the dispensing of liquid out of the container when they get stacked in the dispensing means.

It is an object of the present invention to overcome the above drawbacks while at the same time providing a closure with a piercable part allowing safe usage, good hygiene and sufficient durability, in particular to seal containers to be used in home appliance systems for dispensing beverages such as beer.

SUMMARY OF THE INVENTION

The present invention concerns a closure having a base comprising a piercable part, the piercable part being defined by a sidewall extending transversally with respect to the base and a bottom, said sidewall and/or bottom comprising several lines of weakened material strength, characterized in that said lines divide the sidewall and/or bottom in several wedge formed parts.

Said lines preferably extend in both the sidewall and the bottom of the piercable part.

Preferably, the lines of weakened material strength have a reduced material thickness.

According to a preferred embodiment, the indent has a conically shaped sidewall that may converge up to a point.

According to a further embodiment, the closure preferably comprises a skirt extending transversally from the base while the conical sidewall of the piercable part extends to a same side of the base as the skirt.

The present invention also concerns a container being provided with such a closure.

DESCRIPTION OF THE INVENTION

The present invention concerns a closure having a base comprising a piercable part, the piercable part being defined by a sidewall extending transversally with respect to the base and a bottom, said sidewall and/or bottom comprising several lines of weakened material strength, characterized in that said lines divide the sidewall and/or bottom in several wedge formed parts.

An advantage of a closure according to the present invention is that it can easily be pierced by a dispensing means with a rounded tip and that due to the configuration of the lines of weakened material strength, no material of the closure falls into the container during piercing.

Another advantage of the closure according the present invention is that due to the combination of both the indent and the configuration of the lines of weakened material strength, accidental rupture of the piercable part due to overpressure in the container sealed by the closure is reduced. Indeed, when overpressure occurs in the container, the different wedge formed parts will be pressed towards each other instead of out of each other, such that accidental rupture can be minimized. Moreover, the above design of the closure facilitates piercing of the container as exerting pressure from outside the container on the piercable part, will drive the wedge formed parts apart.

The above advantages will be even enhanced in case the indent has a conical sidewall, converging to that side of the closure which in normal use extends into the container, i.e. when the indent extends on a same side of the base of the closure as the skirt.

The material wherein the closure or at least the piercable part is manufactured can be chosen such that the wedge formed parts can serve as hooks preventing a dispensing means inserted in the closure to be retreated. This is especially desirable for hygiene reasons since contamination of the part of the dispensing means inserted in the container can be prevented.

BRIEF DESCRIPTION OF THE DRAWINGS

In order to better explain the characteristics of the invention, the following preferred embodiments of an assembly according to the invention is given as non-limitative example, with reference to the accompanying drawings, in which.

DETAILED DESCRIPTION OF EMBODIMENT(S)

Figure 1:
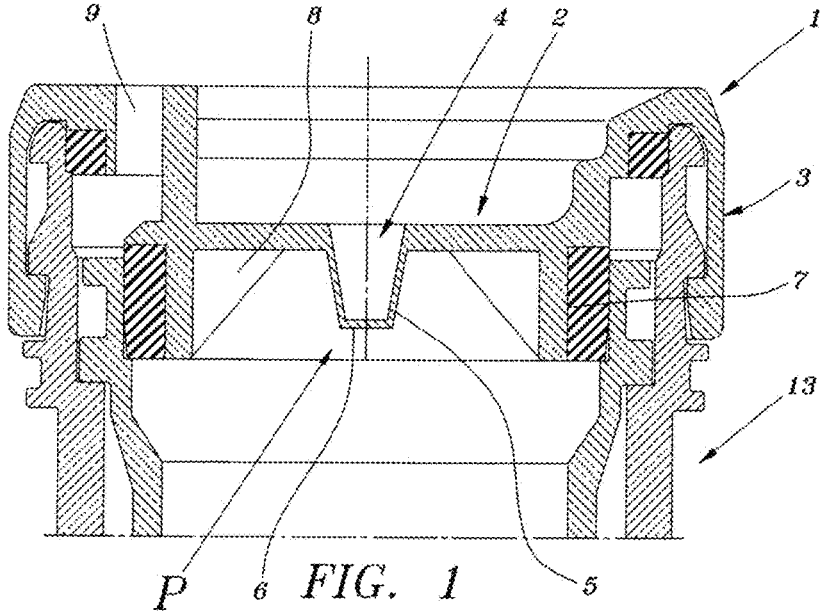
FIG. 1 represents a cross-section of a closure according to the present invention when provided on a container.
Figure 1A:
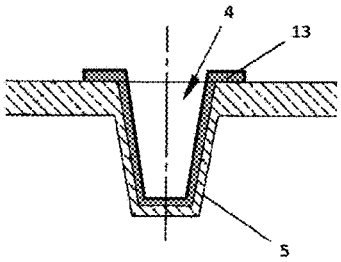
FIG. 1A illustrates a piercable part over-molder with an elastic material.

FIG. 1 represents a part of a closure 1 according to the present invention. This closure 1 comprises a base 2 provided with a skirt 3 at is periphery. The skirt 3 extends in a general transversal direction to one side of the base 2.

The base 2 comprises a piercable part 4 that is defined by a sidewall 5 extending transversally with respect to the base 2 and a bottom 6, thereby creating an indent in the base 2.

In the represented embodiment, the base 2 comprises a cylindrical wall section 7 surrounding the piercable part 4 and extending to the same side of the base as the indent and the skirt 3. Extending radially from the cylindrical wall section 7 towards the piercable part 4 are provided several triangular ribs 8 ensuring the closures stability.

Finally, the base 2 may comprise an access port 9 distinct from the piercable part 4. In this case, the access port is located at the periphery of the base 2, while the piercable part 4 is located centrally in the base 2.

Figure 2:
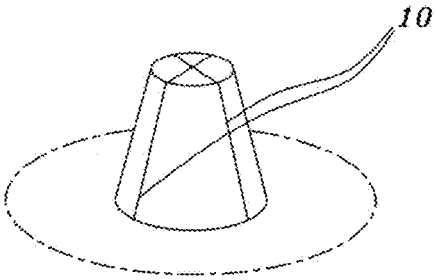
FIGS. 2 to 5 represent simplified perspective views according arrow P, of several possible configurations of a base of a closure according the present invention.

FIG. 2 represents a partial view of a closure according the present invention, wherein the skirt 3 and the ribs 8 on the cylindrical wall section have been omitted for reason of clarity.

According to the present invention, the sidewall 5 and/or the bottom 6 of the piercable part 4 comprise several lines 10 of weakened material strength, said lines 10 dividing the sidewall 5 and bottom 6 in several wedge formed parts 11. In the case that the closure is manufactured in a thermoplastic material such as polyesters or polyolefins, the weakened material strength can be obtained by executing the lines 10 with reduced material thickness in view of the wedged parts 11.

In the embodiment represented in FIG. 2 the lines 10 of weakened material strength extend over both the sidewall 5 and the bottom 6 to join in a point.

Figure 3:
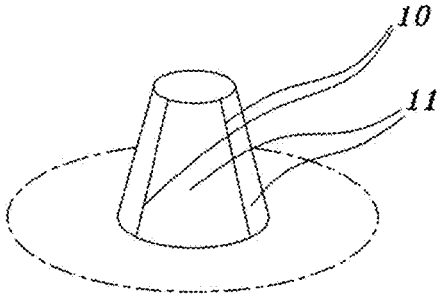
Figure 4:
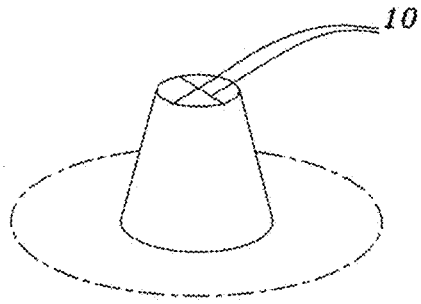

In the embodiments represented in FIGS. 3 and 4, the lines 10 are provided in either the sidewall 5 (FIG. 3) or the bottom 6 (FIG. 4) alone. In embodiment represented in FIG. 3, a optional circular line 10 can be provided at the periphery of the bottom 6.

In all represented embodiments of FIGS. 1 to 4, the sidewall 5 is conically shaped, converging from the base 2 towards the bottom 6 of the indent.

Figure 5:
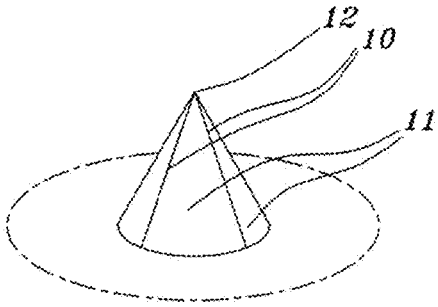
Figure 6:
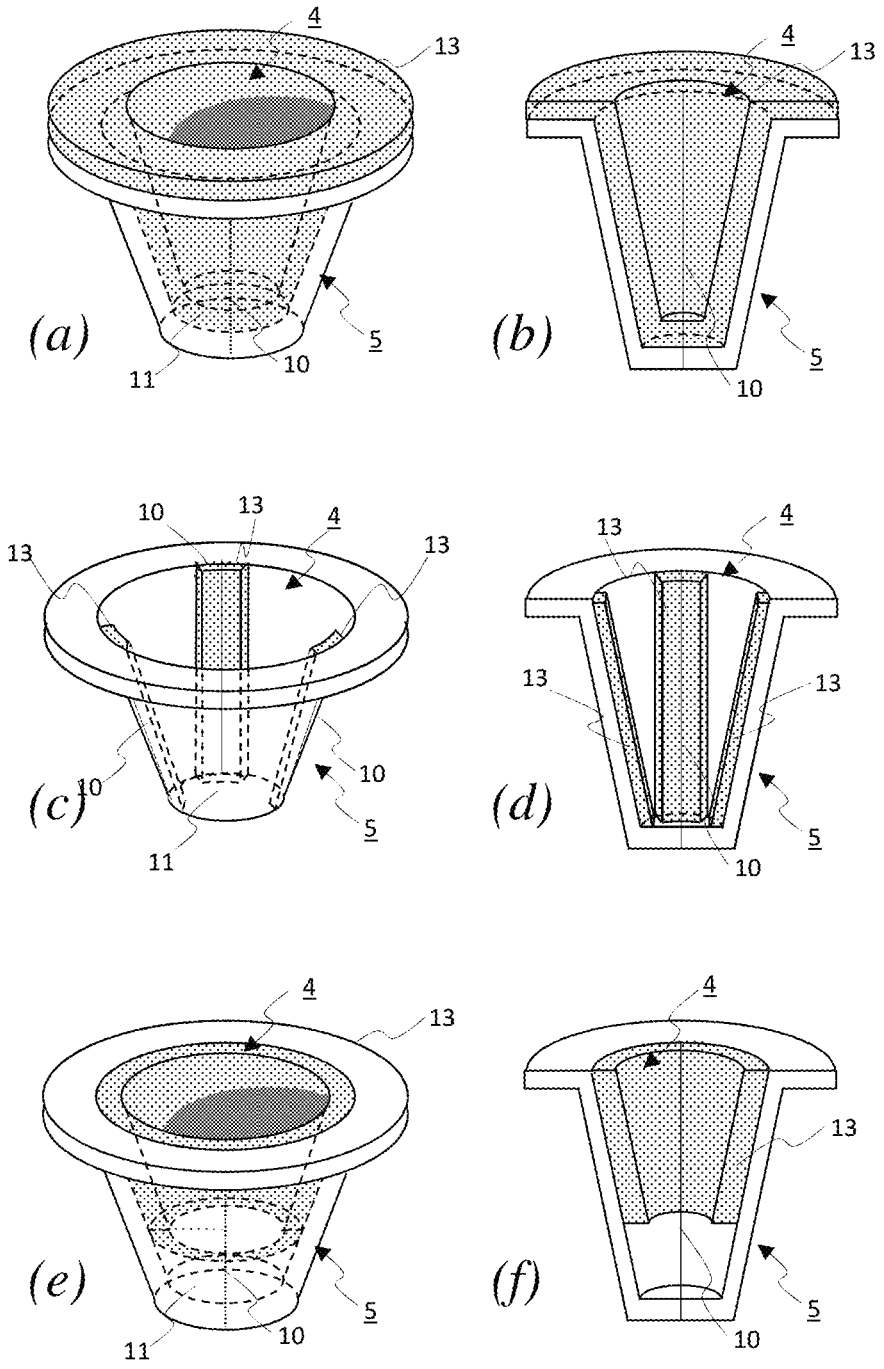
FIGS. 6(*a*)-6(*f*) shows several embodiments of a base according to the present invention comprising an overmold.
Figure 7:
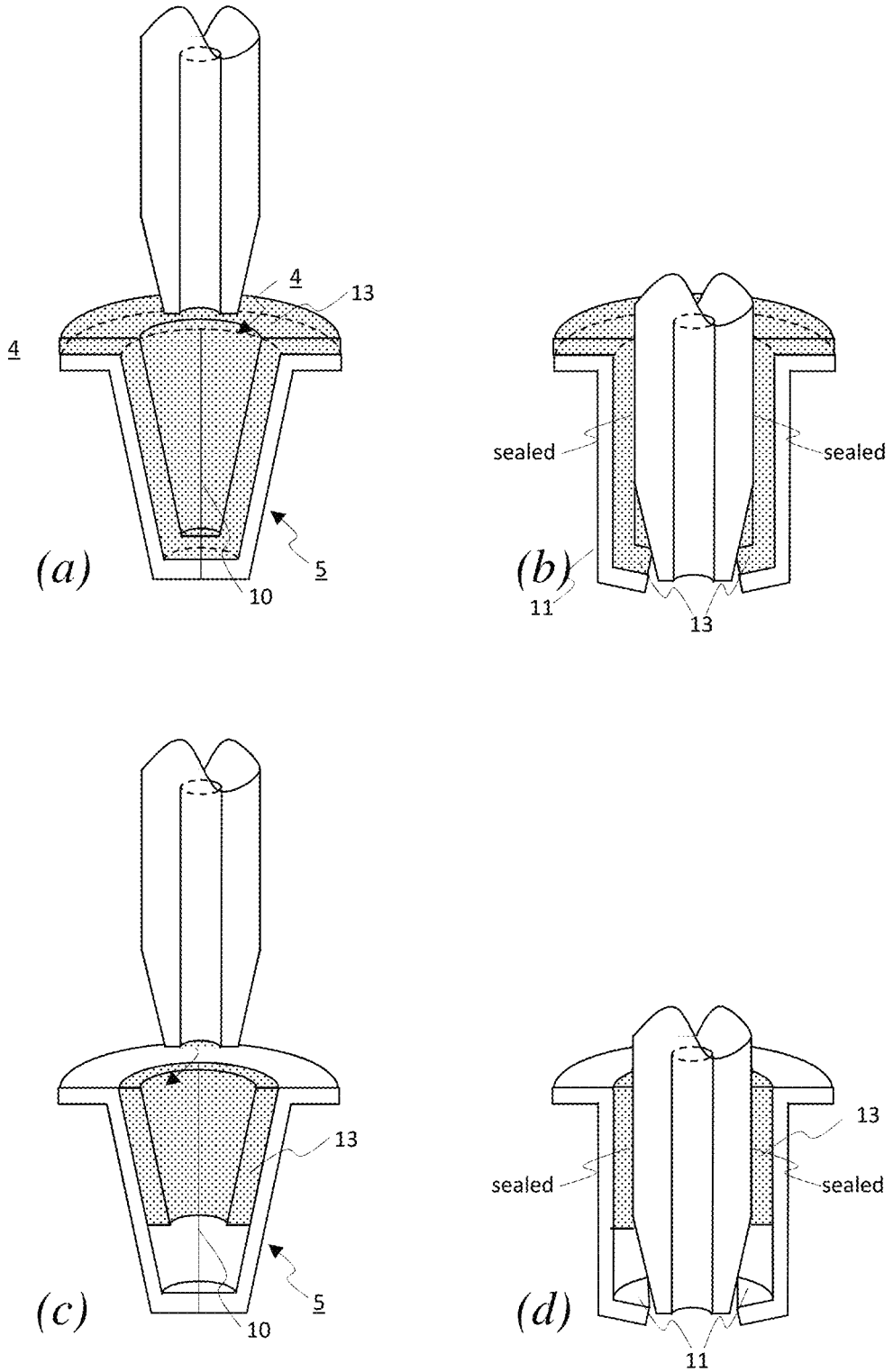
FIGS. 7(*a*)-7(*d*) shows how an overmould can ensure a sealing function upon introduction of a needle.

FIG. 5 represents an embodiment, wherein the sidewall converges in to a point 12, where the lines 10 join each other.

When correctly applied on a container 13, the closure 1 seals an opening thereof, whereby the inside of the container is accessible through the piercable part 4. As represented in FIG. 1, the indent defining the piercable part 4 hereby preferably extends into the container 13.

When piercing the piercable part with a dispensing means, the sidewall and/or bottom will be ruptured in a controlled manner along the different lines 10 provided therein and the resulting wedge formed parts 11 will hinge away from each other towards the base 2 of the closure such that an access to the container is created.

Clearly, as the wedge formed parts 11 remain attached to the base 2, no parts of the closure will fall into the container.

It is further noted that the piercable part 4 can be entirely or partially mover-moulded with an elastic material, or over-mould 13. The over-mould 13 is preferably applied on that side of the piercable part 4 that is meant to be directed outside the container when the closure is correctly applied thereon.

A first function of the over-mould 13 preferably is to protect the lines 10 of weakened material strength from accidental rupture. Secondly the over-mould 13 preferably forms an additional aid against permeation prior and during piercing of the piercable part 4. To further prevent permeation, active scavenging components can be comprised in the over-mould 13. Thirdly, the over-mould 13 is preferably designed to have a sealing function with respect to a needle inserted in the container through the piercable part 4 so that the acquired sealing can prevent leakage from inside the container to outside the container and/or prevent permeation of gases in or outside the container via the interface of wedge and inserted needle.

The material wherein the closure or at least the piercable part is manufactured can be chosen such that the wedge formed parts 11 can serve as hooks preventing a dispensing means inserted in the closure to be retreated. This is especially desirable for hygiene reasons since contamination of the part of the dispensing means inserted in the container can be prevented. If desired, the retreat of the dispensing tube can be prevented even further by providing hooks on the dispensing means that can cooperate with the hooks formed by the wedge formed parts 11.

It is remarked that the closure is especially useful for closing containers for storing carbonated beverages such as beer. In such containers a constant overpressure is present in view of ambient pressure, whereby the overpressure presses the different wedge formed parts 11 towards each other prior to opening the container. As such, accidental rupture of the piercable part from inside the container is unlikely.

The closure according to the present invention, especially when comprising the above mentioned access port, are found to be especially suited to seal containers of the type generally known as bag-in-container. Bag-in-containers, also referred to as bag-in-bottles or bag-in-boxes depending on the geometry of the outer vessel, all terms considered herein as being comprised within the meaning of the term bag-in-container, are a family of liquid dispensing packaging consisting of an outer container comprising an opening to the atmosphere—the mouth—and which contains a collapsible inner bag joined to said container and opening to the atmosphere at the region of said mouth. The system must comprise at least one vent fluidly connecting the atmosphere to the region between the inner bag and the outer container in order to control the pressure in said region to squeeze the inner bag and thus dispense the liquid contained therein.

Traditionally, bag-in-containers were—and still are—produced by independently producing an inner bag provided with a specific neck closure assembly and a structural container (usually in the form of a bottle). The bag is inserted into the fully formed bottle opening and fixed thereto by means of the neck closure assembly, which comprises one opening to the interior of the bag and vents fluidly connecting the space between bag and bottle to the atmosphere; examples of such constructions can be found inter alia in U.S. Pat. Nos. 3,484,011, 3,450,254, 4,330,066, and 4,892,230.

The present invention is by no means limited to the embodiments described above and represented in the accompanying figures; on the contrary, such an assembly of a container and a closure comprising an overpressure relief system can be made in various executions while still remaining within the scope of the invention.

The invention claimed is:

1. A container containing a carbonated beverage to be dispensed using a home appliance, said container comprising an opening and being provided with a closure for sealing said opening, said closure having a base comprising a pierceable part, the pierceable part being pierceable by insertion therethrough of a dispensing tube, said pierceable part being defined by a sidewall extending transversally with respect to the base and a bottom, at least one of said sidewall and bottom comprising several lines of weakened material strength dividing the at least one of said sidewall and bottom in several wedge formed parts, wherein a side of said piercable part facing outside the container when the closure is correctly applied thereon is provided with an overmold having an elastic material that at least partially covers the side to form a seal with respect to the dispensing tube inserted in the container through the pierceable part for preventing leakage from inside the container to outside the container during dispensing of liquid through said dispensing tube.

2. The container according to claim 1, wherein the carbonated beverage is beer.

3. The container according to claim 1, wherein the lines of weakened material strength have a reduced material thickness.

4. The container according to claim 1, wherein the pierceable part has a conically shaped sidewall.

5. The container according to claim 1, wherein both the sidewall and the bottom are provided with said lines of weakened material strength.

6. The container according to claim 1, wherein the sidewall converges up to a point.

7. The container according to claim 1, wherein the closure comprises a skirt extending transversally from the base and in that the pierceable part comprises a conical sidewall extending to a same side of the base as the skirt.

8. The container according to claim 1, wherein the container comprises an access port distinct from the pierceable part.

9. The container according to claim 1, wherein the pierceable part is located centrally in the base, the access port being located at the periphery of said base.

* * * * *